US011628675B2

(12) United States Patent
Seshaiya Doriaswamy Chandrasekar

(10) Patent No.: US 11,628,675 B2
(45) Date of Patent: Apr. 18, 2023

(54) INKLESS PRINTING METHOD, INKLESS PRINTER, AND PRINTED SUBSTRATE

(71) Applicant: MACSA ID, S.A., Sant Fruitos De Bages (Barcelona) (ES)

(72) Inventor: Venkatesh Seshaiya Doriaswamy Chandrasekar, Rotterdam (NL)

(73) Assignee: MACSA ID, S.A., Sant Fruitos de Bages (ES)

( * ) Notice: Subject to any disclaimer, the term of this patent is extended or adjusted under 35 U.S.C. 154(b) by 0 days.

(21) Appl. No.: 17/289,956

(22) PCT Filed: Nov. 29, 2019

(86) PCT No.: PCT/EP2019/083192
§ 371 (c)(1),
(2) Date: Apr. 29, 2021

(87) PCT Pub. No.: WO2020/109612
PCT Pub. Date: Jun. 4, 2020

(65) Prior Publication Data

US 2022/0009262 A1 Jan. 13, 2022

(30) Foreign Application Priority Data

Nov. 30, 2018 (NL) ..... 2022105

(51) Int. Cl.
*B41M 5/26* (2006.01)
*B41M 5/36* (2006.01)
(Continued)

(52) U.S. Cl.
CPC ..... *B41J 2/4753* (2013.01); *B41J 2/442* (2013.01); *B41M 5/24* (2013.01); *B41M 5/267* (2013.01); *B41M 5/36* (2013.01); *B41M 5/382* (2013.01)

(58) Field of Classification Search
CPC ..... B41M 5/267; B41M 5/36; B41M 5/382; B41J 2/442; B41J 2/4753
See application file for complete search history.

(56) References Cited

U.S. PATENT DOCUMENTS 5,977,514 A * 11/1999 Feng ..... B41M 5/267 264/409
5,990,917 A * 11/1999 Wendt ..... B41C 1/055 347/187

(Continued)

FOREIGN PATENT DOCUMENTS

WO 2018/009070 A1 1/2018
WO 2018/102633 A1 6/2018

OTHER PUBLICATIONS

International Search Report for International Patent Application No. PCT/EP2019/083192, dated Feb. 6, 2020 in 2 pages.

*Primary Examiner* — Christopher E Mahoney
*Assistant Examiner* — Kendrick X Liu
(74) *Attorney, Agent, or Firm* — Knobbe, Martens, Olson & Bear, LLP

(57) ABSTRACT

The invention relates to an inkless printing method. The invention also relates to an inkless printing device, in particular configured to perform at least a part of the method according to the invention. The invention furthermore relates to a substrate provided with at least one printed marking realised by applying the method according to the invention and/or the device according to the invention.

27 Claims, 8 Drawing Sheets

(51) Int. Cl.

| | |
|---|---|
| ***B41M 5/382*** | (2006.01) |
| ***B41J 2/44*** | (2006.01) |
| ***B41J 2/475*** | (2006.01) |
| ***B41M 5/24*** | (2006.01) |

(56) References Cited

U.S. PATENT DOCUMENTS

| | | | | |
|---|---|---|---|---|
| 2005/0218125 | A1* | 10/2005 | Addington | B41M 5/267 219/121.68 |
| 2016/0052293 | A1* | 2/2016 | Seshaiya Doraiswamy Chandrasekar | B41J 2/4753 347/175 |
| 2020/0079108 | A1* | 3/2020 | Kueckendahl | B41J 2/442 |
| 2020/0331235 | A1* | 10/2020 | Minamikawa | B32B 15/09 |

* cited by examiner

INKLESS PRINTING METHOD, INKLESS PRINTER, AND PRINTED SUBSTRATE

CROSS-REFERENCE TO RELATED APPLICATIONS

This application is the U.S. National Phase under 35. U.S.C. § 371 of International Application PCT/EP2019/083192, filed Nov. 29, 2019, which claims priority to Netherlands Patent Application No. 2022105, filed Nov. 30, 2018. The disclosures of the above-described applications are hereby incorporated by reference in their entirety.

FIELD OF THE INVENTION

The invention relates to an inkless printing method. The invention also relates to an inkless printing device, in particular configured to perform at least a part of the method according to the invention. The invention furthermore relates to a substrate provided with at least one printed marking realised by applying the method according to the invention and/or the device according to the invention.

BACKGROUND OF THE INVENTION

Inkless printing devices rely on the thermal process of selective carbonization to print or mark on substrates comprising cellulose such as paper and cardboard without the need of ink. This selective carbonization, i.e. the inkless printing, can be applied to regular substrates omitting the need of special coatings, special heat sensitive paper or special wavelength-sensitive paper. Another benefit is that there is no need for the use of consumables such as toners which is beneficial from environmentally point of view. This also applies to the omission of ink.

For the quality of the print it is important that the contrast between the print and the substrate is sufficient. An adequate contrast is in particular relevant when printing text, numbers and/or barcodes. Laser-based inkless devices can already achieve a desired, and therefore optimal, contrast, however, therefore the printing needs to be performed at relatively low scan speeds. Additionally, it is recommended that the print is made on a white background such as white paper or white cardboards, since further types of non-white substrates, such as brown cardboards, may result in a decreased contrast between the substrate and the print, resulting in a lower quality of the print. Applying a relatively low scan speed, compared to conventional printers, is also required for optimising the blackness of the print. When operating at low scan speed the print can achieve the lowest lightness value, which corresponds to a relatively high blackness. However, the low scan speed results in a relatively long, and from a commercial point of view unacceptably long, printing time.

SUMMARY OF THE INVENTION

It is a first object to provide an improved inkless printing method and/or inkless printing device.

It is a second object to provide an improved inkless printing method and/or inkless printing device by means of which markings with sufficient blackness can be printed in a shorter period of time.

At least one of these objects can be achieved by providing an inkless printing method according to preamble, comprising the steps of: A) providing at least one carbonizable substrate, B) determining at least one carbonization related characteristic of said carbonizable substrate, C) defining at least one printing zone of the substrate, D) at least one time position-selectively carbonizing said at least one defined printing zone of the substrate by position-selectively irradiating of said printing zone of the substrate by using at least one primary irradiation source to form at least one printed marking within said defined printing zone, and, optionally, E) at least one time irradiating of at least a part of said at least one defined printing zone, by using at least one secondary irradiation source, such that each printing zone is irradiated at least twice during the (overall) execution of step D) and step E). It has been found that irradiating the at least one printing zone, or at least a part thereof, a plurality of times, will significantly increase the blackness of the printed marking to a satisfying blackness level in a limited amount of time. Hence, by applying this method the printing speed can be increased significantly which is favourable from an economic and commercial point of view. A satisfying blackness level is often defined by the lightness level L as defined in a CIELAB colour space, which is, in this particular context, preferably equal to or below 30. Each printing zone is typically completely carbonized. Hence, the boundaries of each printing zone define the boundaries of each marking printed. The marking may be formed by text and/or by a(nother) graphical representation. Typically each marking is created within its own printing zone. Hence, a word, consisting of x characters, to be printed, is typically initially defined by x printing zones. However, it is also imaginable that a printing zone is defined as a dot, being a part of a graphical representation, such as a letter, text, images, graphics, etc. . . . However, it is also imaginable that in one printing zone a plurality of distinctive markings is eventually printed during step D). As already indicated above, Step E) is used to accelerate the generation of an inklessly printed marking with sufficient blackness in order to save precious time, by pre-irradiating and/or post-irradiating the printed zone (part) irradiated during step D). More details and preferred embodiments are presented below.

During step B) one or more carbonized substrate related characteristics are determined, which are useful and/or needed for the subsequent printing process. This characterization, as performed during step B), can be performed automatically and/or manually. Examples of carbonized substrate related characteristics are the substrate type, the substrate thickness, the initial substrate colour, the substrate material, the substrate layer composition. An additional carbonized substrate related characteristic, which is preferably determined during step B), optionally based upon one or more other carbonized substrate related characteristics (e.g. as defined in the previous sentence), is the (minimum) carbonization temperature of the carbonizable substrate. Typically, in case cellulose based substrates, like paper and/or carton, are used, the minimum carbonization temperature will be around 250-300 degrees Celsius. Above this temperature the substrate will discolour (change colour), and will in particular darken, while below this temperature no, or at least no significant colour change occurs.

The carbonization used during step D) of the method according to the invention is typically based upon pyrolysis, and hence is also referred to as pyrolytic carbonization. The advantages of pyrolytic carbonization is that carbon can be produced in a relatively simple and cost-efficient manner, without needing complicated facilities. Typically, at an early stage of pyrolysis (400° C.<T<600° C.), cyclization and aromatization proceed in the carbonizable substrate, typically formed by an organic precursor, with the release of various organic compounds like hydrocarbons, and inorganic matters such as CO, CO2, H2O, mainly because some of the C—C bonds are weaker than C—H bonds. Over 600° C., out-gassing is typically hydrogen (H2) due to the polycondensation of aromatics. Up to 1500° C., though this temperature doesn't have to be necessarily reached, the residues which have "suffered" from carbonization may be called carbonaceous solids though they might still contain hydrogen. Above 1500° C., graphitization begins so the residues contain more than 99% of C which are thus called carbon materials. The occurrence of reactions, including cyclization, aromatization, polycondensation and graphitization, depends strongly on the substrate used as well as heating conditions. Sometimes these processes overlap with each other throughout pyrolysis and therefore, the whole process from precursor to the final carbon residues is often simply called "the carbonization". In the method according to the invention at least cyclization and aromatization take place, but preferably also polycondensation, and more preferably also graphitization, will or may take place, in order to reduce the electrical resistance of the formed tracks and pads as much as possible.

With reference to FIG. 6*a*, it is indicated that research teaches that there is a relationship between heat treatment temperatures (HTT) and electrical resistivity of different carbonizable substrates (1, 2, 3, 4), in particular biomass precursors. More in particular, an increase of HTT, within a temperature range of 350-900 degrees Celsius, declines observably the electrical resistivity, thus indicating a rise of electrical conductivity. Pyrolysis up to 750° C. allow to convert all types of biomass into conducting agents, which is also in agreement with the fact that the higher heat treatment temperature is, the purer carbon material is obtained. From this point of view, it is desired to apply a carbonization which is considerably higher than the minimum carbonization temperature of about 400 degrees Celsius. Here, it is for example preferred to use a temperature of 750-800 degrees Celsius in order to get relatively good conductivity results while using a relatively limited amount of irradiated energy.

Moreover, with reference to FIG. 6*b*, it is indicated research also shows that heating rate is important for the char yield and the char properties in cellulose pyrolysis. This research showed that a change of heating rate from 70 to 0.03 degrees Celsius per minute (° C./min) results a considerable increase in char yield from 11% to 28% at the end of pyrolysis at 900° C. This is most likely due to a prolongation of dehydration reaction at low temperature (<240° C.), which leads also to thermally more stable char with a low oxygen content. This higher carbon particle or carbon fibre content normally provides a higher blackness of the realized track and/or pad. With examination of char properties, it was concluded that low heating rates help likewise to yield highly porous but dense chars. This leads to the insight that is preferred to apply a restricted heating rate which is lower than or equal to 30 degrees Celsius per minute, preferably lower than or equal to 15 degrees Celsius per minute, in case only a single irradiation step would be performed. However, in case more irradiation steps are performed, for example by preheating and/or post-irradiation, the substrate, as also described in this patent specification, then (significantly) higher heating rates could be applied, which is interesting from an economic and commercial point of view.

It has also been found that the flame retardants could facility and stabilize the pyrolysis process of the carbonizable substrate. For example, the preferred presence of dihydrogen phosphate (GDP), ammonium phosphate (DAP), and diguanidine hydrogen phosphate (DHP) in and/or on the substrate leads to an increase of 33% on carbon yield. Moreover, water-soluble organosilicon, whether alone or mixed with other ammonium additives, also helps increasing carbon yield to an important extent and improving simultaneously mechanical resistivity of carbon particles and carbon fibres. It was also found that impregnation of the substrate with a diluted sulfuric acid solution before step D) is performed, or conducting the pyrolysis process of step B) in a hydrogen chloride (HCl) atmosphere helps increase the carbon yield to 38%. Hence, it is preferred that the substrate is treated with at least one of the aforementioned additives prior to performing step D) and/or to subject the substrate during step D) in an acidic environment. Instead of applying an acidic environment during step D), it will be clear that step D) may also be applied in air (atmospheric conditions) or in an inert atmosphere.

Carbonizable substrates refer to substrates, in particular sheets or layers, which can get carbonised at elevated temperature, typically temperatures of 400 degrees Celsius and higher. Examples of carbonizable substrates are cellulose based materials like paper, brown carton, wood, etcetera. It is also conceivable that the substrate is formed by a carbonizable polymer, like polyimide. The substrate may be rigid and/or flexible.

Step E) may be initiated prior to step D). This is commonly advantageous to heat the substrate and/or the defined printed zone(s) thereof. More preferably, during step E) at least the at least one defined printing zone of the substrate is heated to a temperature below the carbonization temperature defined during step B). Research has turned out that this preheating step will significantly improve and accelerate the follow-up carbonization step (step D)) to create one or more marking with sufficient blackness. The preheating step (step E) when initiated prior to step D)) is preferably realized by using an infrared (IR) light source as at least one secondary irradiation source is an infrared (IR) light source. This infrared light source may, for example, by formed by an infrared laser and/or by an heated oven.

It is imaginable that the primary irradiation source is configured to act as secondary irradiation source. Optionally, step E) could be identical to step D), wherein at least a part of the at least one printed zone is irradiated at least twice with the same type of radiation (same wavelength (spectrum)). However, the radiation type (wavelength (spectrum)) used during step D) typically differs from the radiation type (wavelength (spectrum)) used during step E). Also in this latter embodiment, it is imaginable that that the primary irradiation source is configured to act as secondary irradiation source, for example by using a tuneable laser. A tuneable laser is a laser whose wavelength of operation can be altered in a controlled manner.

During the preheating step E), if applied, and normally provided that the substrate temperature will stay below the minimum carbonization temperature, the colour of at least one defined printing zone remains unchanged during irradiating of said at least one defined printing zone according to step E). This preheating step is predominantly intended to sort of activate the substrate, or at least the at least one heated zone(s) thereof, which works as a catalyst for subsequent carbonisation towards a sufficient black marking.

In an alternative preferred embodiment, step D) is initiated prior to step E). According to this embodiment, at least a part of the printing zone(s) is carbonized first, after which the carbonized parts are irradiated again during step E). The post-irradiation step (step E)) increases the blackness level of the initial printed marking(s). In case step D) is performed at a relatively high speed, the resulting marking(s) are typically brownish due to a relatively high tar fraction compared to the char fraction created during the pyrolytic carbonisation. Post-irradiating, also referred to as post-illumination, typically changes this tar/char ratio, wherein at least a part of the tar fraction is converted into char, leading to a more black print. Hence, in this preferred embodiment, the colour of at least one defined printing zone is effected during irradiating of said at least one defined printing zone according to step E). It is conceivable that during step E) only a part of at least one printing zone defined during step C) is irradiated. This could lead to a desired optical effect that the peripheral edge of a marking remains brown(ish), while the center portion of said marking is more black(ish). Preferably, at least one secondary irradiation source is formed by a laser configured to emit radiation with a wavelength of between 455 and 529 nm. This types of lasers are also referred to a blue lasers, green lasers, and blue-green lasers. Research has shown that in particular these kind of lasers emitting radiation with a wavelength in between 455 and 529 nm is very efficient to turn brown marking into black, also in a relatively short period of time.

In a particular preferred embodiment, step E) comprises two substeps: E1) at least one first time irradiating of said at least one defined printing zone, by using at least one first secondary irradiation source, and E2) at least one second time irradiating of said at least one defined printing zone, by using at least one second secondary irradiation source, wherein substep E1) is initiated prior to step D), and wherein step D) is initiated prior to substep E2). In this embodiment, both pre-irradiation (preheating) and post-irradiation (post-illumination) is applied. In this manner, each printing zone is typically irradiated at least three times during the execution of step D) and step E). This at least triple irradiation may further increase the blackness of the printed marking(s) and/or may allow a further increase of the overall printing speed to generate the marking(s). Hence, in this embodiment at least two (different) secondary irradiation sources may be used, at least one first secondary irradiation source to carry out step E1), and at least one second secondary irradiation source to carry out step E2).

It is imaginable that step D) and step E) are executed successively (sequentially), in particular in the orders D)-E), E)-D), and/or E1)-D)-E2). However, it is also imaginable that step D) and step E) at least partially overlap in time. It is even imaginable that step D) and step E) are executes completely simultaneously.

The at least one primary irradiation source is preferably a diode laser and/or a gas laser, in particular a carbon dioxide (CO2) laser. Carbon dioxide lasers are the highest-power continuous wave lasers that are currently available. And they are also quite efficient: the ratio of output power to pump power can be as large as 20%. The CO2 laser typically produces a beam of infrared light with the principal wavelength bands centering on 9.4 and 10.6 micrometres (μm). Lasers typically operate relatively fast and, moreover, are flexible, as a result of which lasers are ideally suitable to create different markings within a short time frame.

In a preferred embodiment, at least one primary irradiation source is configured to transform the irradiated beam between a narrow beam and a broad beam, preferably by using refracting optical means, wherein the narrow beam is configured to only irradiated at least a part of the at least one printing zone, and wherein the broad beam is configured to irradiated at least a part of the substrate beyond said at least one printing zone. The broad beam is preferably configured to irradiate both at least a part of the at least one printing zone and at least a part of the substrate beyond said at least one printing zone. The narrow beam has a (significantly) higher power density than the broad beam. The broad beam may have a power density which varies from the center to the peripheral edge. More in particular, the broad beam may comprises a center beam (inner beam) and a sheath beam (outer beam) surrounding said center beam, wherein the center beam may have a higher power density than the sheath beam. The broad beam is configured to (pre)heat the substrate, including a printing zone still to be printed, which may accelerate the subsequent carbonization process in said printing zone. The carbonization process is typically realized by means of the narrow beam, and optionally by the center beam of the broad beam. Preferably, during step D) the narrow beam of the at least one primary irradiation source is used, and wherein during step E) the broad beam of the said primary irradiation source, acting a secondary irradiation source, is used.

In a preferred embodiment, the at least one marked formed during step D) may be transferred to another substrate, also referred to as transfer substrate. This transfer substrate may or may not be carbonizable. An example of a (non-carbonizable) substrate is PDMS, which has (rubber-) elastic properties and is therefore, for example, more suitable (than e.g. carton) to be integrated in a wearable device. This transfer step may thus provide more freedom of design for the completion of the electronic circuit and/or the application of the track(s) and/or pad(s) created. An example of this transfer process is shown in FIG. 7, wherein FIG. 7(*ii*) shows the formation of an electrically conductive track onto paper or carton, wherein the track is subsequently covered by a transfer substrate, such as PDMS, (FIG. 7(*iii*)), after which the transfer substrate is removed from the paper of carton (FIG. 7(*iv*)/(*v*)). Hence, according to this embodiment, the method according to the invention preferably comprises step F), comprising the step of transferring the at least one marking printed during step D) onto a transfer substrate, after which the original carbonizable substrate is removed from the at least one transferred marking. In this embodiment, the original substrate and the marking formed thereon/therein a separated from each other during this transfer step.

It is conceivable that during step D) the at least one defined printing zone of the substrate is irradiated at least a plurality of times, in particular 2, 3, 4, or 5 times, by at least one primary irradiation source. This overlapping printing process will typically also improve the darkness (blackness) of the printed marking(s). It is even conceivable that step E) may be omitted in case sufficient blackness it achieved by applying this repetitive printing step D) according to this embodiment.

In a preferred embodiment, the method comprises step G), comprising position-selectively whitening at least a part of at least one defined printing zone of the substrate by position-selectively irradiating of said printing zone of the substrate by using a laser, preferably a gas laser, more preferably a CO2 laser, having an output power up to 20 Watt, wherein the laser scanning speed is at least 1 m/s, preferably at least 5 m/s, more preferably at least 7 m/s. It has surprisingly been found coloured, in particular brown, cellulose-based substrates seem to whiten at a region of high laser scanning speed, printing in focus, at a low laser power (5 to 30 watts). When prints are made at higher laser powers in focus, the whitening effect reduces and when printed out of focus, the whitening effect also reduces. Hence, this whitening effect can be realised best by using a laser having a low output power (up to 30 Watt), and preferably also in focus. This photochemical bleaching phenomena is most likely causes by removal and/or modifying of coloured constituents of the coloured substrate, resulting in a whitish appearance. This whitened area (print) realized during step G) can, for example, be used as a (relatively white (light)) background on which a brown, preferably black, barcode or other information is printed (inklessly) thereby enhancing the contrast between the whitish background and the dark print (marking(s)). It is hence conceivable that during step G) at least one substrate part beyond, and preferably adjacent to, the at least one defined printing zone is whitened. The laser used during step G) may be formed the primary irradiation source. The whitening step G) is typically initiated prior to the carbonization step D). A representative chart is shown in FIG. 8, wherein the lightness L (as defined in the CIELAB colour space) of the carbonizable substrate, in this case brown carton, is shown at different laser output powers, both for an 'in focus' laser beam and for an 'out of focus' laser beam, at a relatively laser scanning speed of 7620 mm/s. The chart demonstrates that the best whitening is obtained with a laser power of 10-30 Watt. It is, for example, possible that the photochemical bleaching is performed by irradiation of at least part of the substrate with an irradiation source using a power density in a range of 20 kW/cm2 to 140 kW/cm2 and applying a irradiation time of at most 55 microseconds. The irradiation source can be either the primary irradiation source used for the carbonization of the substrate or a further secondary irradiation source. The irradiation of at least part of the substrate with an irradiation source, preferably a laser, with a power density in the range of 20 k W/cm2 to 140 kW/cm2, preferably 30 k W/cm2 to 120 kW/cm2, and an irradiation of 55 microseconds or below results in a thermal shock of the substrate. The thermal shock (also) provides the photochemical bleaching effect.

The method according to the invention preferably comprises step H), comprising the step of increasing the bond strength between at least one marking printed and/or to be printed during step D) and the substrate. This will lead to an improved fixation of the printed marking(s) onto the substrate. Increasing the bond strength can be realized in different manners, wherein step H) can be performed prior and/or after step D), and wherein step H) can be performed prior and/or after step E). In particular in case step H) is performed prior to step D), step H) is preferably based upon treating the substrate with a bond strength improving coating, which can, for example, by spraying, preferably by using one or more spray nozzles, onto the substrate prior to step D). This bond strength improving coating may also be applied after carbonization according to step D). The coating may be configured to react with the marking(s) to intensify the bond between the marking and at least one of the substrate and the coating. It is also imaginable that step H) comprises the step of further irradiating the at least one marking, such that the bond strength between said at least one marking and the substrate is improved (intensified). It is also imaginable that step H) comprises the step of apply mechanical pressure onto the at least one marking formed during step D), which may also lead to an increase of the bond strength of said at least one marking onto the substrate. Applying a pressure may, for example, be realized by using a roller.

The invention also relates to an inkless printing device, also referred to as inkless printer, to perform at least step C), step D), and step E) of the method according to invention. The device according to the invention may also be configured to perform step A) and/or step B). Preferably, the device comprises: at least one primary irradiation source, at least one secondary irradiation source, and at least one controller to control the at least one primary irradiation source and the at least one secondary irradiation source. As mentioned above, the primary irradiation source and the secondary irradiation source may be formed by the same irradiation source. The device according to the invention preferably comprises refracting optical means to guide and/or shape an radiated beam emitting by the at least one primary irradiation source and/or the at least one secondary irradiation source.

The invention furthermore relates to a substrate provided with at least one printed marking realised by applying the method according to the invention and/or the device according to the invention. Preferably, at least a part of at least one marking has a lightness level L, defined by a CIELAB color space, which is equal to or below 30. Preferably, at least a part of at least one marking is black and/or comprises more char than tar, or has a relatively high char fraction. It is also imaginable that at least a part of at least one marking is left brown on purpose and/or comprises more tar than char, or has a relatively high tar fraction.

BRIEF DESCRIPTION OF THE DRAWINGS

The invention will be elucidated on the bases of non-limitative exemplary embodiments shown in the following figures, wherein.

DETAILED DESCRIPTION OF THE PREFERRED EMBODIMENTS

In these figures, corresponding references correspond to similar or equivalent features.

Figure 1B:
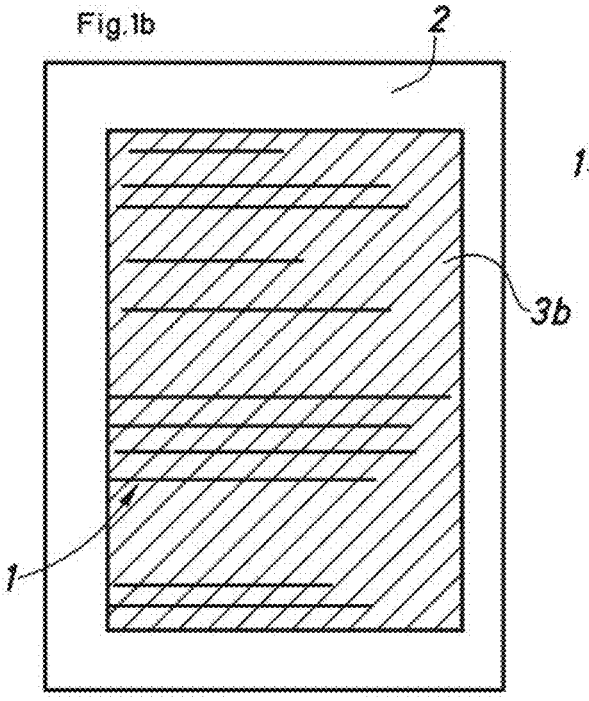
FIGS. 1*b*-1*e* show examples of the predefined area to heated prior to the selective carbonization.
Figure 1A:
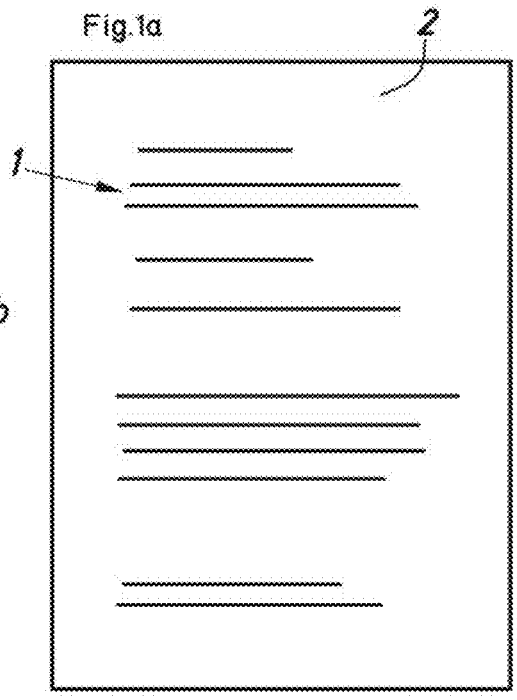
FIG. 1*a* shows a schematic representation of a print obtainable via selective carbonization of a substrate.

FIG. 1*a* shows a schematic representation of an example of a print (1) obtainable via position-selective carbonization of a substrate (2) via the method according to the present invention. The figure shows the carbonized area (1) or print (1) in order to be able to indicate the predefined area(s) of the substrate to be heated prior to the carbonization. Examples of the predefined areas are illustrated in FIGS. 1*b*-1*e*.

FIG. 1*b* shows the substrate (2) as shown in FIG. 1*a*, wherein a predefined area (3*b*) to be heated is indicated via highlighting (3*b*). The determination of the predefined area (3*b*) is based upon the surface enclosed by the desired the print (1) which is to be position-selectively carbonized (printed). The predefined area (3*b*) is heated via an in the present patent application described heating method, preferably via radiative heating such as illumination. As can be seen in the figure, the predefined area (3) to be heated encloses the print (1) entirely.

Figure 1C:
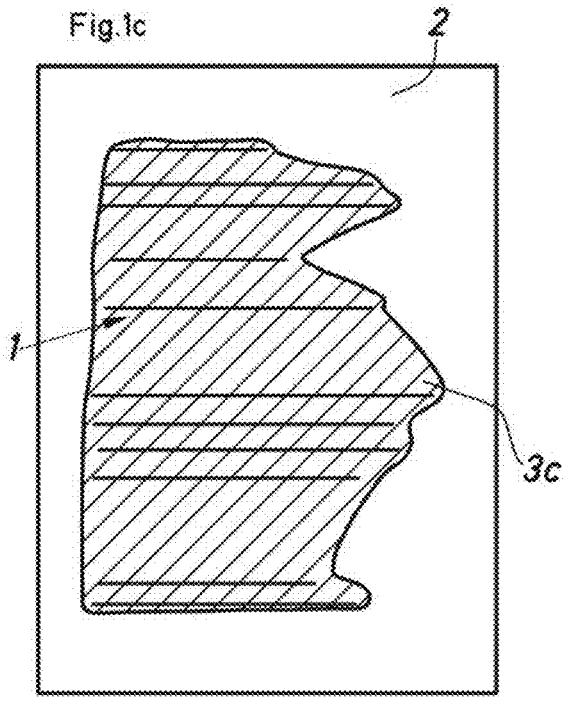

FIG. 1*c* shows a further example how the predefined area (3*c*) of the substrate (2) to be heated can be defined. The predefined area (3*c*) substantially follows the contours of the final print (1). A benefit of this example is that a smaller area (3*c*) has to be heated compared to the example of FIG. 1*b*, resulting in a reduced energy requirement for heating.

Figure 1D:
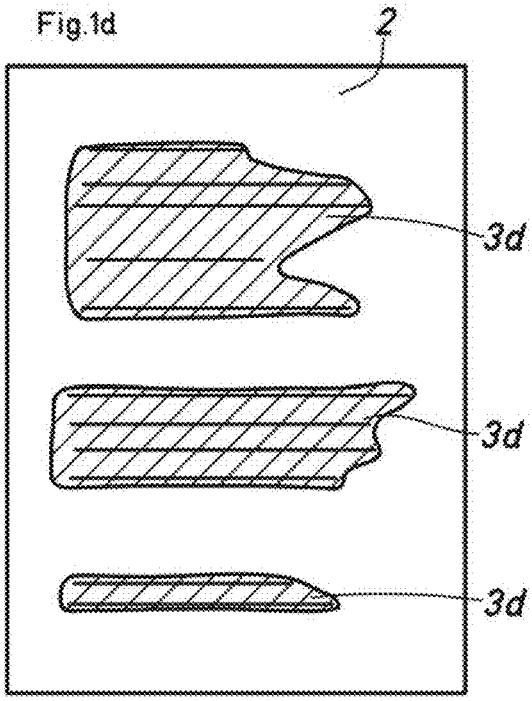

FIG. 1*d* shows a third example of defining the predefined area (3*d*) of the substrate (2) which has to be heated prior to the selective carbonization (1) according to the method according to the invention. The figures shows that multiple predefined areas (3*d*) are indicated, wherein each predefined area (3*d*) substantially follows the contours of the final print (1). For this embodiment, the total area of a substrate (2) which is to be heated substantially at least equals the total area of said substrate (2) which is position-selectively carbonized (1).

Figure 1E:
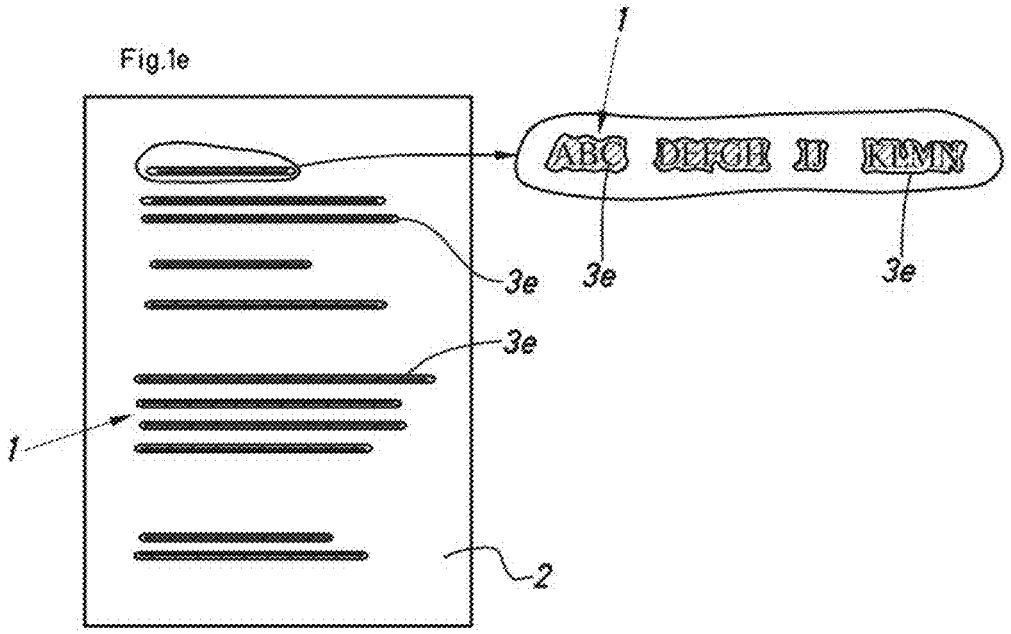

FIG. 1*e* shows a fourth example falling within the scope of the invention of defining the predefined area (3*e*) of the substrate (2) which has to be heated prior to the position-selective carbonization (1). The predefined area (3*e*) to be heated is further reduced compared to the previous examples. The figure shows that the predefined areas (3*e*) are substantially localized with respect to the print (1). This localized heating is in particular achievable via shaping a beam of the primary irradiation source such that the beam is out of focus when it reaches the substrate, such that the sheath of the beam heats the substrate before the core of the beam carbonizes the substrate (2). Examples hereof are shown in FIGS. 2*a* and 2*b*.

For this embodiment, the total area of a substrate (2) which is to be heated substantially equals the total area of said substrate (2) which is position-selectively carbonized (1).

Figure 2A:
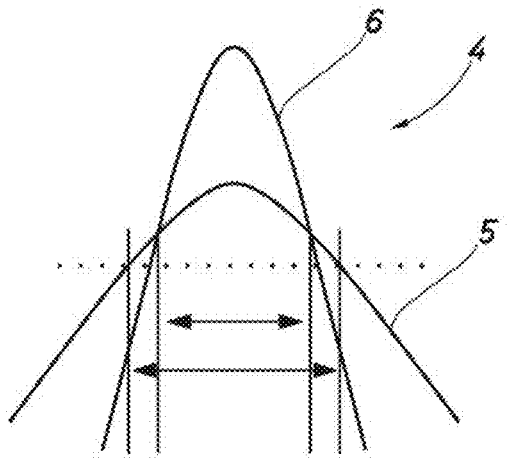
FIGS. 2*a* and 2*b* show a schematic representation of an irradiation source to be used in the method, and device, according to the invention.
Figure 2B:
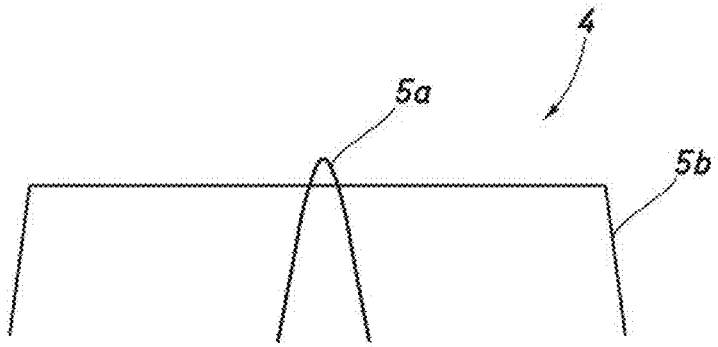

FIGS. 2*a* and 2*b* show a schematic representation of an irradiation source (4) to be used in the method, and device, according to the invention. In the shown example is the irradiation source (4) a laser (4). FIG. 2*a* shows both a beam of a laser (4) which is in focus (6) and a beam which is out of focus (5). FIG. 2*b* shows a schematic representation of the beneficial effects of the out of focus beam (5) for selective carbonization without losing on the resolution of the final print. For the out of focus situation is it required that the beam of the primary irradiation source (4) is shaped such that the beam is out of focus when it reaches the substrate, such that the sheath of the beam (5*b*) heats the substrate (2) before the core of the beam (5*a*) carbonizes the substrate (2). The beam of the laser (4) can for example pass through beam shaping optics (not shown) which modifies the shape of the beam. The beam shape of the laser is preferably modified such that the beam can be used to both pre-heat and post heat the substrate (2). With this beam shaping, the power distribution can be designed to get the optimal temperature for blackening in the most optimal heating rate by altering the power density distribution.

Figure 3:
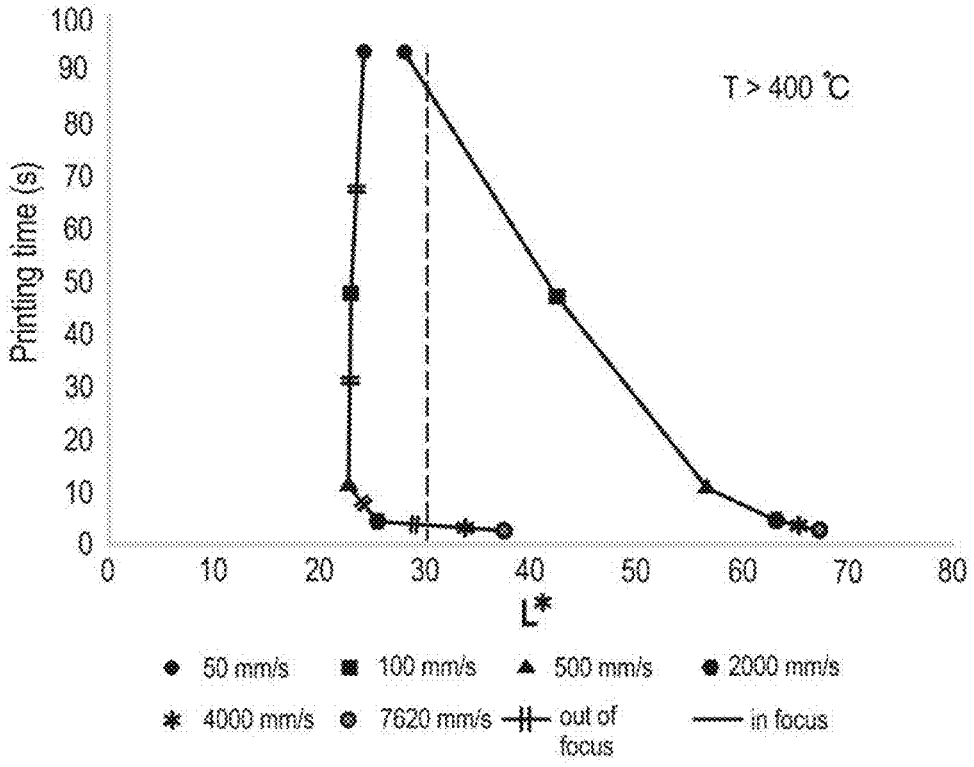
FIG. 3 shows the effect of pre-heating of the substrate before selective carbonization according to the invention.

FIG. 3 shows the effect of pre-heating of the substrate before selective carbonization according to the invention. The figure shows in particular the effect of using a beam of an irradiation source which is out of focus with respect to a beam which is in focus. The x-axis shows the lightness level (L*) of the print. The values are measured by using a calorimeter. A lightness level below 30 corresponds to an acceptable blackness, and therewith contrast, of the print. The y-axis show the printing time (in seconds). For this experiment blocks of approximately 20×20 mm were printed. The speed of the galvanometer, and therewith the speed of the laser beam, used for printing, has a direct correlation to the printing time. The higher the speed, the shorter the time required for printing. The measurement point for different speeds (mm/s) are indicated in the figure for both an out of focus beam and an in focus beam. The substrate used is conventional brown carton. It can be seen that a higher blackness is obtained when the substrate is preheated via the sheath of the beam which is out of focus. Furthermore, higher laser speeds can be used, and the required printing time is reduced for any laser speed.

Figure 4:
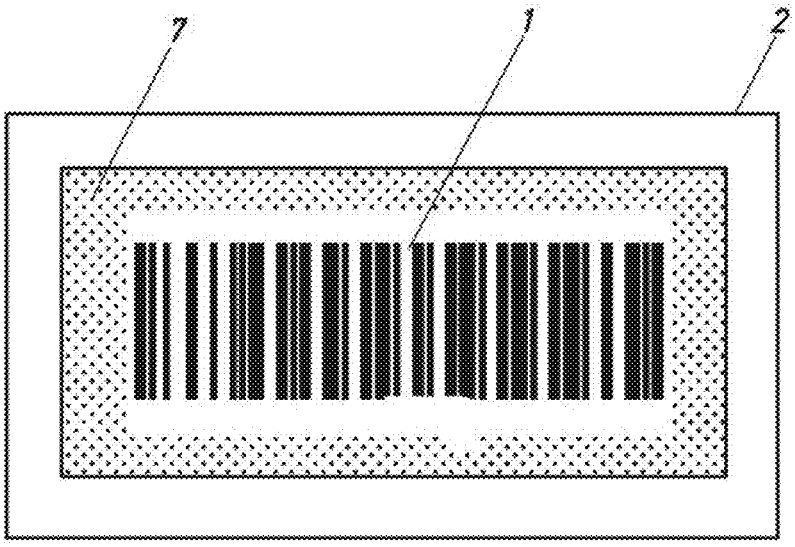
FIG. 4 shows a schematic representation of a substrate printed via a method according to the invention.

FIG. 4 shows a schematic representation of a substrate (2) printed via a method according to the invention. The figure show a substrate (2) having a print (1) which is printed via selective carbonization of the substrate. The print (1) is provided on a predefined area (7) which is subjected to a photochemical bleaching step. The predefined area (7) therefore has a lighter colour than the substrate (2) in its original form, which is beneficial for the contrast between the print (1) and the background (7) thereof.

Figure 5:
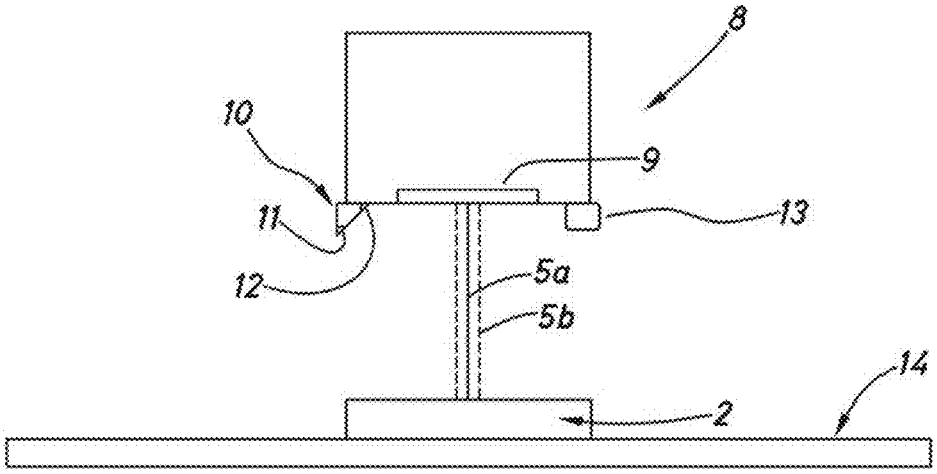
FIG. 5 shows a schematic representation of a device according to the invention.
Figure 6A:
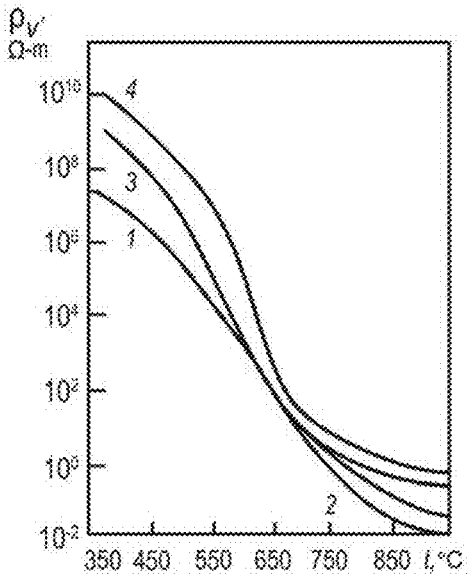
FIG. 6*a* illustrates a graph of heat treatment temperatures (HTT) vs. electrical resistivity for different carbonizable substrates.
Figure 6B:
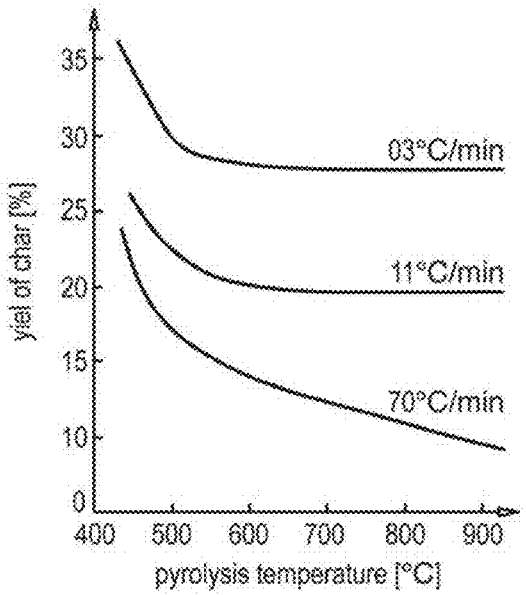
FIG. 6*b* illustrates a graph of pyrolysis temperature vs. char yield for heating rate from 70 to 0.03 degrees Celsius per minute (° C./min).
Figure 7:
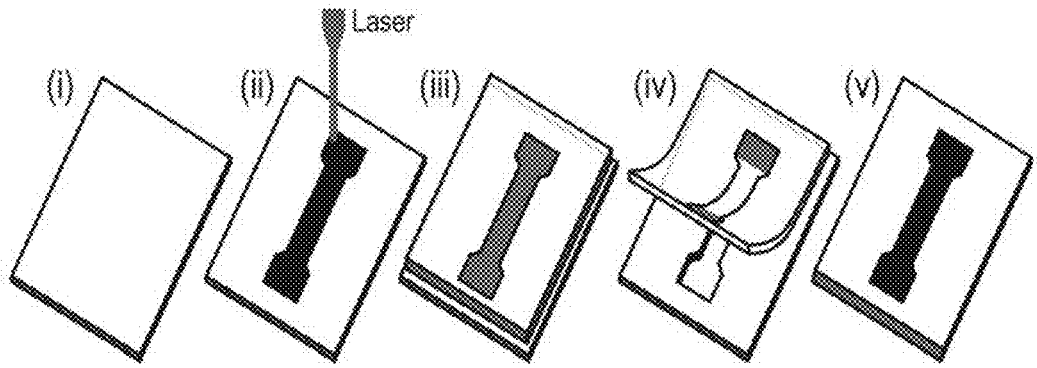
FIG. 7 shows transfer process of the marking.
Figure 8:
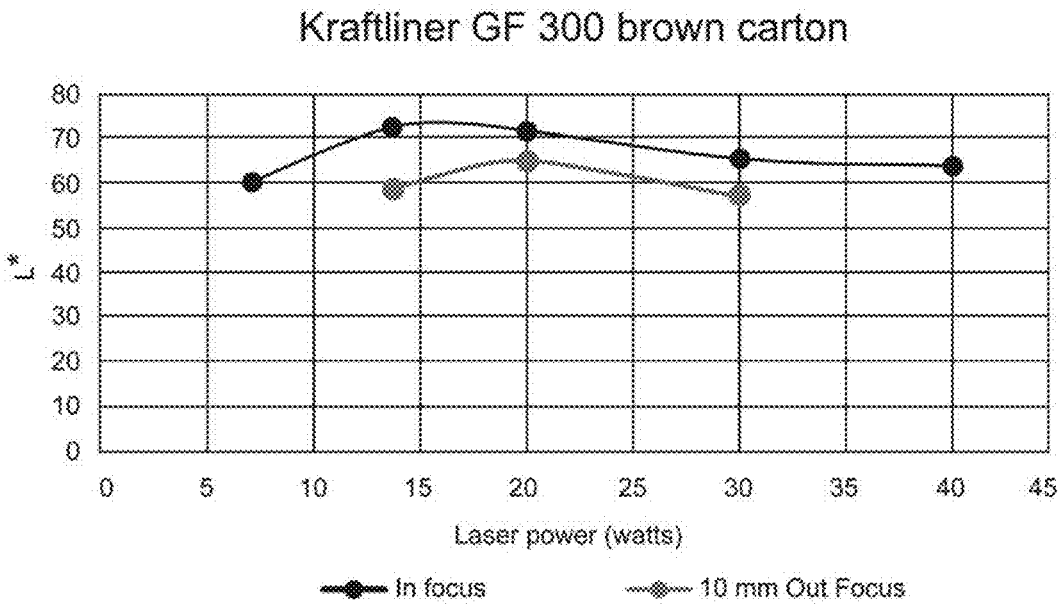
FIG. 8 illustrates a graph of the lightness L of the carbonizable substrate vs. laser output power for an 'in focus' laser beam and for an 'out of focus' laser beam.

FIG. 5 shows a schematic representation of a printing device (8) according to the present invention. The device (8) is configured for selective carbonization of a substrate (2). The device (8) comprises a heating source for at least partially heating at least one substrate, and a primary irradiation source (9), in particular a laser, for at least partially irradiating a substrate such that carbonization of at least part of the substrate occurs. In the shown embodiment forms the heating source an integral part of the primary irradiation source. The device (8) comprises adjusting means for adjusting the beam of the primary irradiation source (9), in particular the laser (9), such that said beam comprises a core (5*a*) and a sheath (5*b*), wherein said sheath (5*b*) is configured for heating at least a predefined area of the substrate (2) before said core (5*a*) of the beam carbonizes at least part of said predefined area of the substrate (2). The device (8) furthermore comprises a control unit (10) for controlling at least the primary irradiation source (9). Additionally, the device (8) comprises a colour sensor (11) and a non-contact temperature sensor (12). The device optionally comprises an extractor (13) for removing volatile compounds. The substrate (2) is in the shown embodiment positioned on a moving stage (14). It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof. Where the term "print" is used a selective carbonized marking is meant. Where the term "irradiation" is used, this may be interpreted as "direct irradiation", wherein an, optionally, shaped, irradiated beam directly (without intervention of an intermediate layer or intermediate component) hits the substrate, and may also be interpreted as "indirect irradiation", wherein an, optionally, shaped, irradiated beam indirectly, via at least one intermediate layer or intermediate component, hits the substrate. An example of an intermediate layer could be, for example, a transparent plate and/or another substrate.

What is claimed is:

1. An inkless printing method, comprising a sequence of steps which are performed in the following order:

A) providing at least one carbonizable substrate,

B) determining at least one carbonization related characteristic of said at least one carbonizable substrate, C) defining at least one printing zone of the at least one carbonizable substrate, D) position-selectively carbonizing said at least one defined at least one printing zone of the at least one carbonizable substrate by at least one time position-selectively irradiating of said at least one defined printing zone of the at least one carbonizable substrate, by using at least one primary beam irradiation to form at least one printed marking within said defined at least one printing zone, and E) at least one time irradiating of at least a part of said at least one defined printing zone, by using at least one secondary beam irradiation, such that each printing zone is irradiated at least twice during the execution of D) and E), wherein during B) a carbonization temperature of the at least one carbonizable substrate is determined, and wherein during E) the complete at least one carbonizable substrate is heated to a temperature below the carbonization temperature defined during B).

2. The method according to claim 1, wherein during E) the complete at least one carbonizable substrate is heated to the temperature below the carbonization temperature defined during B).

3. The method according to claim 1, wherein the at least one secondary beam irradiation is an infrared (IR) light beam.

4. The method according to claim 1, wherein the at least one primary beam and the at least one secondary beam are emitted from a primary irradiation source.

5. The method according to claim 4, wherein the primary irradiation source is configured to transform the irradiated beam between a narrow beam and a broad beam, wherein the narrow beam acts as the at least one primary beam irradiation and is configured to only irradiate at least a part of the at least one printing zone, and wherein the broad beam acts as the at least one secondary beam irradiation and is configured to irradiate at least a part of the substrate beyond said at least one printing zone.

6. The method according to claim 5, wherein the broad beam is configured to irradiate both at least a part of the at least one defined printing zone and at least a part of the at least one carbonizable substrate beyond said at least one defined printing zone.

7. The method according to claim 5, wherein during D) the narrow beam is used, and wherein during E) the broad beam is used.

8. The method according to claim 1, wherein a color of the at least one defined printing zone remains unchanged during irradiating of said at least one defined printing zone according to E).

9. The method according to claim 1, wherein a color of the at least one defined printing zone is effected during irradiating of said at least one defined printing zone according to E).

10. The method according to claim 1, wherein the at least one secondary beam irradiation is emitted by a laser with a wavelength of between 455 and 529 nm.

11. The method according to claim 1, further comprising a step E') comprising irradiating of said at least one defined printing zone, by using the at least one secondary beam irradiation, wherein E') is initiated prior to D).

12. The method according to claim 1, wherein each defined printing zone is irradiated at least three times during the execution of D) and E).

13. The method according to claim 1, wherein the at least one primary beam irradiation is emitted by a $CO_2$ laser.

14. The method according to claim 1, wherein the at least one primary beam irradiation is emitted by a tuneable laser.

15. The method according to claim 1, wherein the at least one carbonizable substrate provided during A) is formed by a cellulose based substrate.

16. The method according to claim 1, further comprising:

F) transferring the at least one printed marking during D) onto a transfer substrate.

17. The method according to claim 16, wherein the original carbonizable substrate is removed from the at least one transferred marking after F).

18. The method according to claim 1, wherein during D) the at least one defined printing zone of the at least one carbonizable substrate is irradiated at least a plurality of times by at least one primary beam irradiation.

19. The method according to claim 1, further comprising:

G) position-selectively whitening at least a part of the at least one defined printing zone of the at least one carbonizable substrate by position-selectively irradiating of said at least one defined printing zone of the at least one carbonizable substrate by using the at least one primary beam irradiation having an output power up to 30 Watt, wherein the scanning speed is at least 1 m/s.

20. The method according to claim 19, wherein during G) at least one substrate part beyond the at least one defined printing zone is whitened.

21. The method according to claim 19, wherein the the at least one primary beam irradiation used during G) is emitted by a primary irradiation source.

22. The method according to claim 19, wherein G) is initiated prior to D).

23. The method according to claim 1, wherein the method comprises H), comprising increasing the bond strength between at least one marking printed and/or to be printed during D) and the at least one carbonizable substrate.

24. A substrate provided with at least one printed marking realized by applying the method according to claim 1.

25. The substrate according to claim 24, wherein at least a part of the at least one printed marking has a lightness level L, defined by a CIELAB colour space, which is equal to or below 30.

26. The substrate according to claim 24, wherein at least a part of the at least one printed marking is black and/or comprises more char than tar.

27. The substrate according to claim 24, wherein at least a part of the at least one printed marking is brown and/or comprises more tar than char.

* * * * *